US005337819A

United States Patent [19]

Tailby

[11] Patent Number: 5,337,819

[45] Date of Patent: Aug. 16, 1994

[54] WASHING TOOL

[75] Inventor: Roger Tailby, Algard, Norway

[73] Assignee: Den norske stats oljeselskap a.s, Stavanger, Norway

[21] Appl. No.: 77,547

[22] Filed: Jun. 17, 1993

[30] Foreign Application Priority Data

Jun. 29, 1992 [NO] Norway ..... 922557

[51] Int. Cl.[5] ..... E21B 37/08

[52] U.S. Cl. ..... 166/222; 166/317; 166/332

[58] Field of Search ..... 166/67, 222, 223, 186, 166/311, 312

[56] References Cited

U.S. PATENT DOCUMENTS

| | | | |
|---|---|---|---|
| Re. 31,842 | 3/1985 | Weitz | 166/312 |
| 1,695,749 | 12/1928 | Watson | 166/223 |
| 3,310,113 | 3/1967 | Maness | 166/222 |
| 4,349,073 | 9/1982 | Zublin | 166/223 X |
| 4,442,899 | 4/1984 | Zublin | 166/222 X |
| 4,518,041 | 5/1985 | Zublin | 166/312 |
| 4,799,554 | 1/1989 | Clapp et al. | 166/223 X |
| 4,919,204 | 4/1990 | Baker et al. | 166/223 |
| 4,921,044 | 5/1990 | Cooksey | 166/222 X |
| 4,967,841 | 11/1990 | Murray | 166/312 |
| 5,060,725 | 10/1991 | Buell | 166/222 |
| 5,195,585 | 3/1993 | Clemens et al. | 166/222 |
| 5,228,508 | 7/1993 | Facteau et al. | 166/222 X |

FOREIGN PATENT DOCUMENTS

| | | |
|---|---|---|
| WO91/11270 | 8/1991 | World Int. Prop. O. . |
| WO91/14076 | 9/1991 | World Int. Prop. O. . |
| WO93/07356 | 4/1993 | World Int. Prop. O. . |

*Primary Examiner*—Ramon S. Britts
*Assistant Examiner*—Frank S. Tsay
*Attorney, Agent, or Firm*—Foley & Lardner

[57] ABSTRACT

Washing tool for removing internal deposits in tubing parts and components in wells for oil or gas production, wherein the tool is to be run on coiled tubing and to be operated by fluid pressure. The tool comprises a main body (10) provided with discharge nozzles for discharging a washing fluid, and a valve member (12) which is axially movable within the main body (10) under pressure actuation and against a spring force (24), for opening one or more of the discharge nozzles. An external valve member (14) at an upper portion of the main body (10) is arranged for axial movement against the action of a spring (15A) urging the external valve member towards a position for blocking the fluid pressure from above. An actuation sleeve (15) on the external valve member (14) has lateral dimensions related to the dimensions of deposits to be removed, so that the actuation sleeve (15) will move the external valve member (14) to admit the fluid pressure from above, when the sleeve is pressed against a deposit to be removed. The valve member (12) within the main body (10) can be moved by fluid pressure in reciprocating movement between upper and lower positions as long as the fluid pressure from above is present.

9 Claims, 5 Drawing Sheets

WASHING TOOL

BACKGROUND

Many oil and gas wells are prone to deposition of substances, such as mineral salts, usually referred to as scale, on the walls of the various tubular goods and components which are contacted by reservoir fluid. The scaling phenomenon is particularly prevalent for oilfields where pressure maintenance by water injection is practiced. Some of these salts, for example calcium carbonate, may be chemically removed by a relatively small amount of any acid, while others, like barium sulphate, may require copious supplies of a special organic acid to dissolve them. Modern well completion allows easy removal of calcium carbonate and similar scales in many cases, whereas barium sulphate removal usually entails pulling the tubular goods that can be pulled and/or milling out scale on permanently installed tubulars.

SUMMARY OF THE INVENTION

It is the intention of this invention to provide a means of applying the relevant acid in sufficient quantities to certain critical areas of wells in order to dissolve scale deposits which obstruct the wellbore at these points and prevent correct operation of the well.

It is noted at this point that the invention is not exclusively intended for scale deposits, but will also be useful for removing deposits of heavy hydrocarbons, cement or dehydrated drilling mud solids, where jetting with fluids or chemicals may be effective.

The most critical areas in the tubing string installed in a well are known as nipples. They usually consist of constrictions in the wall of the tubing in the form of polished bores and stop mechanisms involving shoulders or profiles. The present invention is specially applicable when several profile-type nipples of similar inner diameter are installed in the well, but is also of use for shoulder-type nipples.

The washing tool apparatus of the present invention is intended to be run into the well on coiled tubing, either in the conventional manner well known to those skilled in the art, or in the manner of copending U.S. patent application Ser. No. 07/689,513, the so-called CTP technique, or in the manner of copending Norwegian patent application number 913990, the so-called PACT technique. These two latter techniques are of special interest in this respect since they are dependant on profile-type nipples, and are susceptible to problems arising from scale deposition and the subsequent blocking of access for tools.

Reference is also made to U.S. Pat. Nos. 4,919,204, 4,967,841 and 4,518,041, all relating to washing heads or sleeves being rotatable or adapted to cover angular ranges, and all being directed to similar purposes as the present invention. The same comments also apply to international patent publication WO 91/11270 which relates to a particular form of jet cleaning by means of a fluid containing particles in an abrasive mixture. The present invention, however, is essentially directed to employing a washing fluid being free of particles and being preferably a solvent.

Somewhat more interesting than the above patent specifications is international patent publication WO 91/14076 which describes a jet cleaning device for mounting between drill collars and the drill bit at the bottom of a drill string, for removing deposits on the borehole wall. The device comprises an axially displaceable valve member which upon pressure actuation can be moved for opening radially directed jet openings or nozzles. A corresponding function can be found also in U.S. Pat. No. Re. 31,842 which, however, is directed to a somewhat different purpose, i.e. the washing of a zone in a producing formation to enhance the flow of fluids therefrom.

Thus, on the background of known techniques as discussed above, this invention relates to a washing tool for removing internal deposits in pipes, and tubes, and particularly in tubing parts and components in boreholes and wells for oil or gas production, wherein the tool is adapted to be run down at the end of hollow tubing means such as coiled tubing and to be operated by means of fluid pressure through said tubing means, comprising a main body having a generally hollow cylindrical shape and provided with more or less radial holes for discharging a washing fluid, and a valve member which is axially movable within the main body under pressure actuation and against a spring force, for opening one or more of the discharge holes in the main body.

The novel and specific features in the present washing tool, according to the invention, primarily consist therein that said more or less radial discharge holes are in the form of respective small and large nozzle openings for washing fluid jets, located along a lower portion of said main body, that an external valve member at an upper portion of said main body is arranged for axial movement in relation to the main body against the action of a spring tending to urge said external valve member in a direction downwards to a position for blocking said fluid pressure from above through said tubing means, that an actuation sleeve is associated with said external valve member and is provided with outer parts having maximum lateral dimensions determined in relation to the dimensions of deposits to be removed, so that said actuation sleeve will move said external valve member axially upwards in relation to said main body with a resulting admission of said fluid pressure from above, when said sleeve is pressed against a deposit to be removed, and that said valve member within the main body is adapted to be moved axially by said fluid pressure between an upper position in which a relatively small fluid flow is allowed through said small nozzle openings with the simultaneous formation of a sufficiently high pressure difference axially across said valve member for overcoming the force of said spring, and a lower position in which a substantially larger fluid flow is allowed through said large nozzle openings with a simultaneous strong reduction of said pressure difference, so that said valve member is pressed by said spring back to its upper position, and then alternately continues in reciprocating movement between its upper and lower positions as long as said fluid pressure from above acts through said tubing means.

This solution involves the essential advantage of activation of the washing tool by the actual deposits to be removed. Upon such actuation an automatic reciprocating movement of the internal valve member will be performed, which results in alternate or intermittent washing fluid jets which are very effective in dissolving and removing deposits.

Other novel and specific features of this invention are also described in the following description and the appended claims. For example, the provision of a hollow ball swivel joint for connection of the present washing tool to the tubing means referred to above, makes the tool suitable to be run below the circulation point in a well equipped for through-flowline (TFL) service. Instead of coiled tubing, the tubing means may consist of hollow jointed rods for conveying the washing fluid down to the point in the well where washing is desired. The invention also comprises a particular series circulation valve for establishing washing fluid access to the washing tool.

BRIEF DESCRIPTION OF THE DRAWINGS

The present invention and the manner of operation of the washing tool or apparatus, hereinafter referred to as a Nipple Washing Tool, will be better understood with reference to the attached FIGURES in which.

DETAILED DESCRIPTION OF THE PREFERRED EMBODIMENTS

Figure 1:
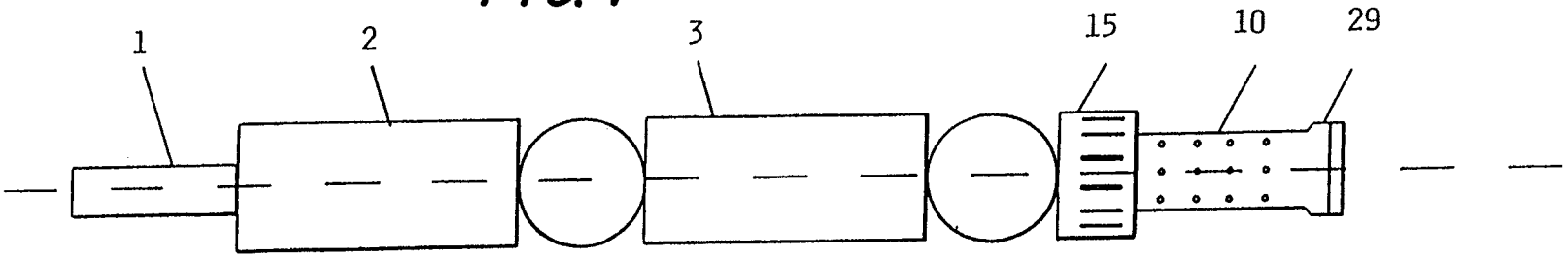
FIG. 1 schematically shows the Nipple Washing Tool attached to the lower end of a length of coiled tubing via a connector and a Series Circulation Valve designed to facilitate operation of the Tool, FIG. 2 in partial axial section shows the Tool as it is run into the well, and before actuating the Series Circulation Valve, FIG. 3 in a similar view as FIG. 2 shows the Tool with a bypass valve thereof opened by contacting scale in a nipple.

In the example of an arrangement as shown in FIG. 1 the following parts, units or components are seen: The lower end of hollow tubing means 1 such as coiled tubing, a coiled tubing connector 2, a series circulation valve 3 and a washing tool 10, 15. As indicated ball or swivel joints (no numeral), which are preferably hollow for fluid passage thereto, are provided between units or components 2, 3 and 10, 15.

To a large degree the following description will be with reference to the actual operation of the washing tool for removing scale deposits within a nipple type component in a tubing string.

Figure 2:
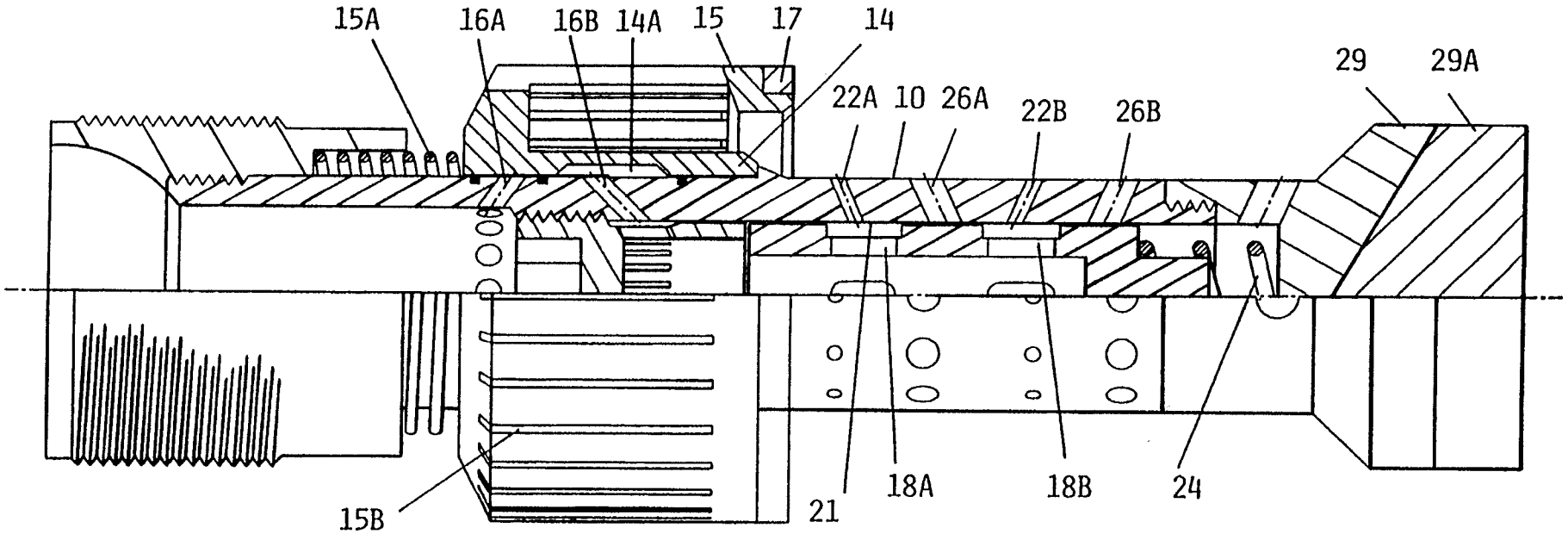

Under normal circumstances, the presence of scale will already have been established, either by a gauge survey or by another tool failing to enter the nipple in question. The Tool 10, 15 is then run as shown in FIG. 1, on coiled tubing 1. The Series Circulation Valve 3, if run, is initially closed, and should be opened by applying pressure inside the coiled tubing when the scaled nipple is reached. FIG. 2 shows the position of the Tool's components at this time.

Upon opening the Series Circulation Valve 3, the pressure in the coiled tubing 1 has access to the Tool 10,15. The Tool basically consists of a main body or mandrel 10 enclosing a shuttle valve member 12 and an external bypass valve member 14 surrounding the mandrel at its upper end. The bypass valve 14 is operated by a spring loaded sleeve-like cage 15 with an outer diameter slightly less than the inner diameter of the nipple which is to be washed.

Spring loading of sleeve or cage 15 is provided for by a helical compression spring 15A, acting against the upper side of cage 15, or the external bypass valve member 14, which is preferably integral with the sleeve-like cage 15. In the position of valve member 14 shown in FIG. 2, it blocks fluid pressure supplied from above through the coiled tubing, but upward movement (to the left in FIG. 2) of valve member 14 will bring internal milled slots 14A therein to an axial position in which they form flow passages between ports 16A and 16B in the main body or mandrel 10, as will be explained below.

Figure 3:
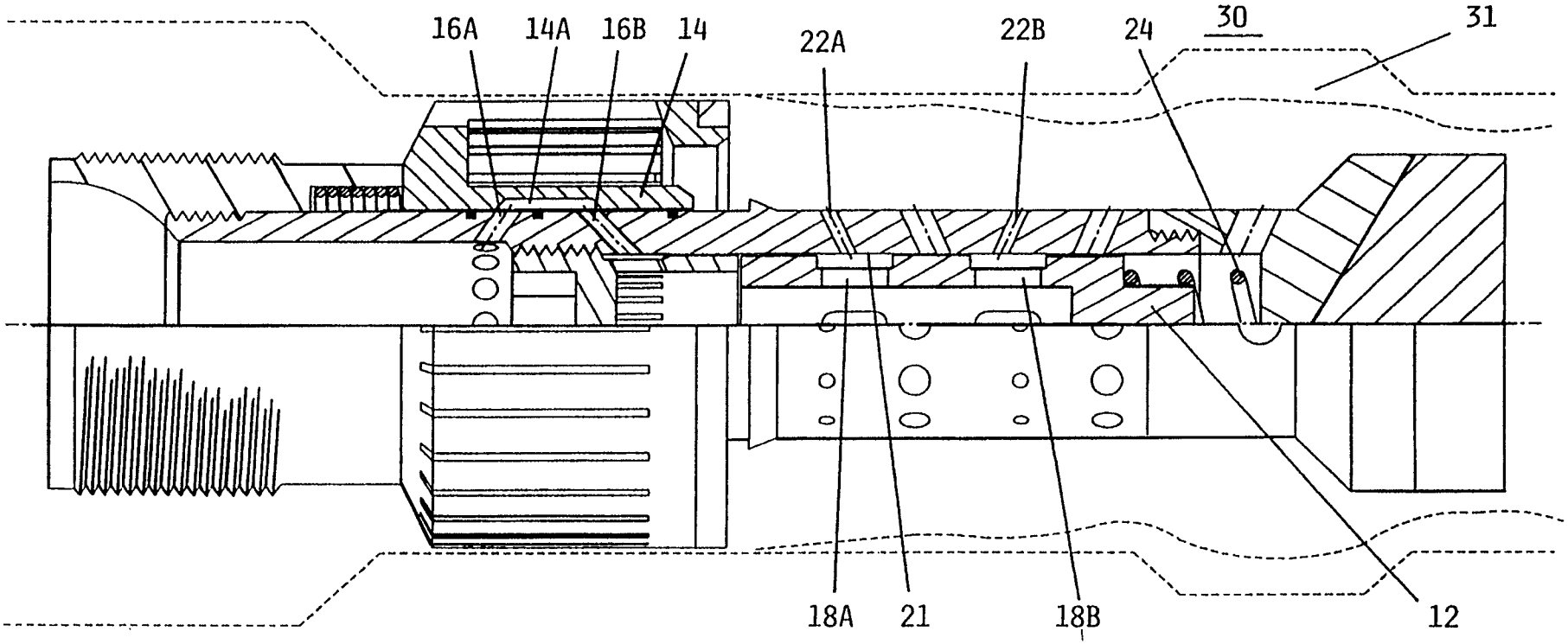

The scale in the nipple results in a decreased inner diameter such that the cage 15 can not pass therethrough. Downward force exerted by tubing 1 results in the cage being pushed back against the upper spring 15A, thereby moving the internal milled slots 14A into a position where they convey the pressure in the coiled tubing 1 through ports 16A, 16B into the lower part of the mandrel 10, as in FIG. 3.

The shuttle valve 12 is machined fit in a lower bore 21 of the mandrel 10, with minimal bypass on the outside, but without seals to block flow entirely. Pressurized fluid in the mandrel bore escapes through slots 18A, 18B in the shuttle valve 12 and through small holes 22A, 22B in the mandrel, resulting in a jet of fluid being sprayed onto the scale coating 31 on the inner surface of nipple 30. Fluid pressure also builds such that a differential pressure exists across the shuttle valve 12, since the small holes 22A, 22B are much smaller than the ports 16A, 16B in the mandrel 10 and the slots 14A in the bypass valve 14.

Figure 4:
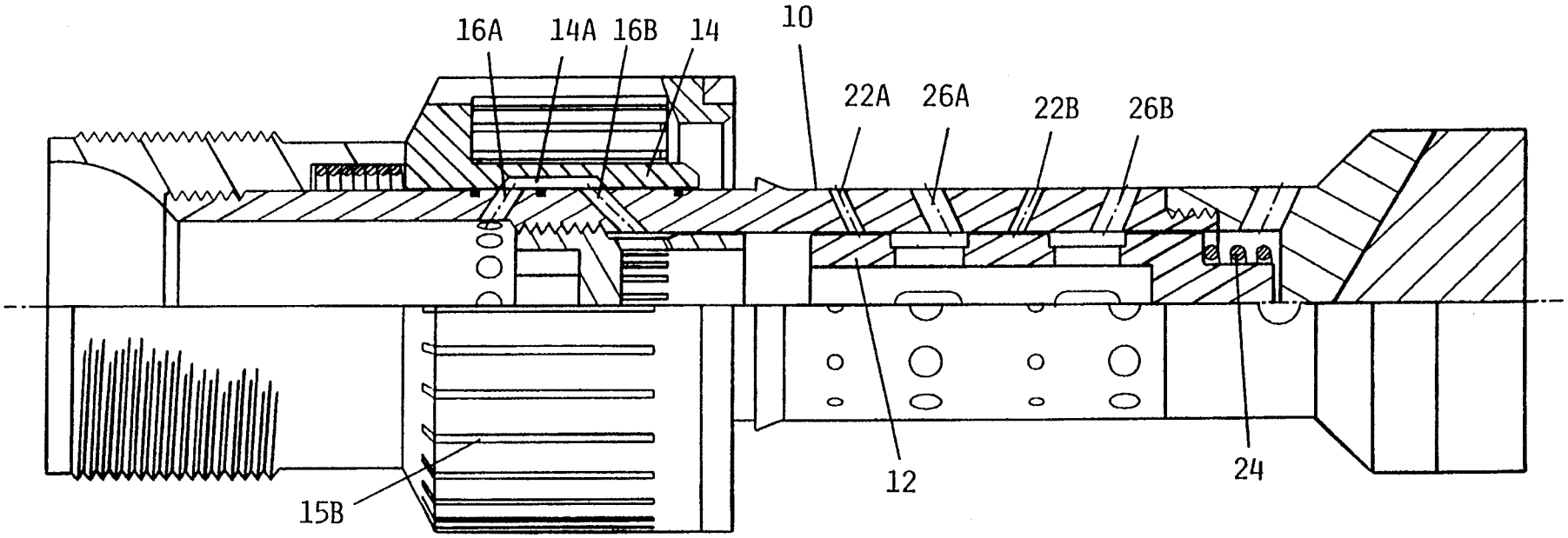
FIG. 4 shows a shuttle valve member in the Tool in open position.

This differential pressure is enough to force the shuttle valve 12 downwards against a lower spring 24, thereby opening it, as shown in FIG. 4. When open, the shuttle valve slots 18A, 18B are aligned with large holes 26A, 26B in the mandrel 10. These holes are much larger than the ports 16A, 16B in the mandrel and the slots 14A in the bypass valve 14, and therefore the differential pressure that has been built up dissipates. Without the differential pressure opposing it, the lower spring 24 closes the shuttle valve 12, allowing differential pressure to build up again, and the cycle repeats. Since there are no seals on the outside of the shuttle valve member 12, and therefore minimal friction, this cycle is expected to repeat very rapidly.

The result of these automatic cycles is alternating jets of fluid out of the small holes 22A, 22B and spurts of fluid out of the large holes 26A, 26B, both of which impinge on the scale coating 31 on the wall of nipple 30 at different places and in a sequence which gives ideal conditions for dissolving and dislodging scale. The fluid introduced into the wellbore in this manner, along with solid flakes and chips freed by the jetting motion, return to the surface through slits 15B in the cage 15, which traps the large particles and retains them for further dissolution until their size is small enough not to cause problems for subsequent operations.

Both small and large discharge holes 22A,B resp. 26A,B may be angled more or less in relation to the radial direction to ensure optimal coverage of the nipple bore. Such angled holes or nozzle openings need not be radially balanced because the resultant reaction torque will only result in rotation of the Series Circulation Valve 3 and not torque buildup in the coiled tubing 1.

Figure 6:
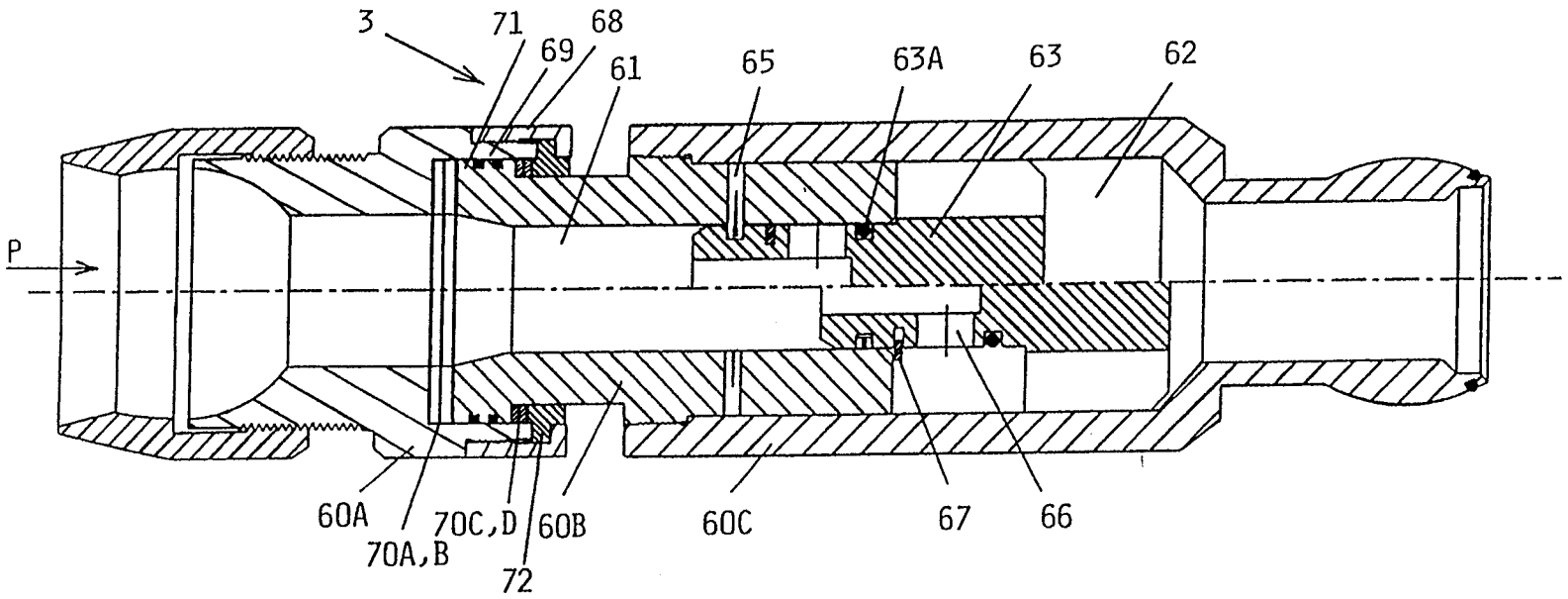

This is due to the swivel arrangement at the top of the Series Circulation Valve shown in FIG. 6.

A downward force is maintained on the coiled tubing 1 during this process such that the cage 15 will progress downwards as scale 31 is dissolved in front of it, while holding the bypass valve 14 open. As soon as the Tool reaches a position where scale no longer impedes its progress, the upper spring 15A closes the bypass valve 14 and fluid circulation ceases while the whole assembly proceeds deeper into the well.

The Tool 10, 15 may be obstructed by non-particulate debris, for example metal objects, commonly referred to as junk. In this case, washing will not result in downward progress. The Tool has a lower nose part 29 designed to minimise this occurrence due to its large diameter. Large junk will stop the Tool by restraining the nose 29, with the result that the external actuating or bypass valve 14 will not open and circulation will not be attained. This occurrence will be noticed by observing surface pressures, and the Tool 10, 15 will be retrieved. In the lower part of the nose 29, there is a receptacle which can be filled with lead 29A. This lead should retain an impression of the junk for identification purposes. The same will happen if there is no scale in the nipples, when the impression in the lead nose 29—29A will be of an item in the well which finally stops the toolstring, typically a lock mandrel or plug.

There is also a receptacle for lead 17 or similar material in the outer leading edge of the sleeve-like cage 15. In the case when the junk is so small as to evade the nose 29, but stops the cage, the Tool will appear to function correctly, but scale will only be washed where the Tool stops. Upon retrieval, an impression in the lead 17 in the cage 15 should reveal the presence of junk.

Figure 5:
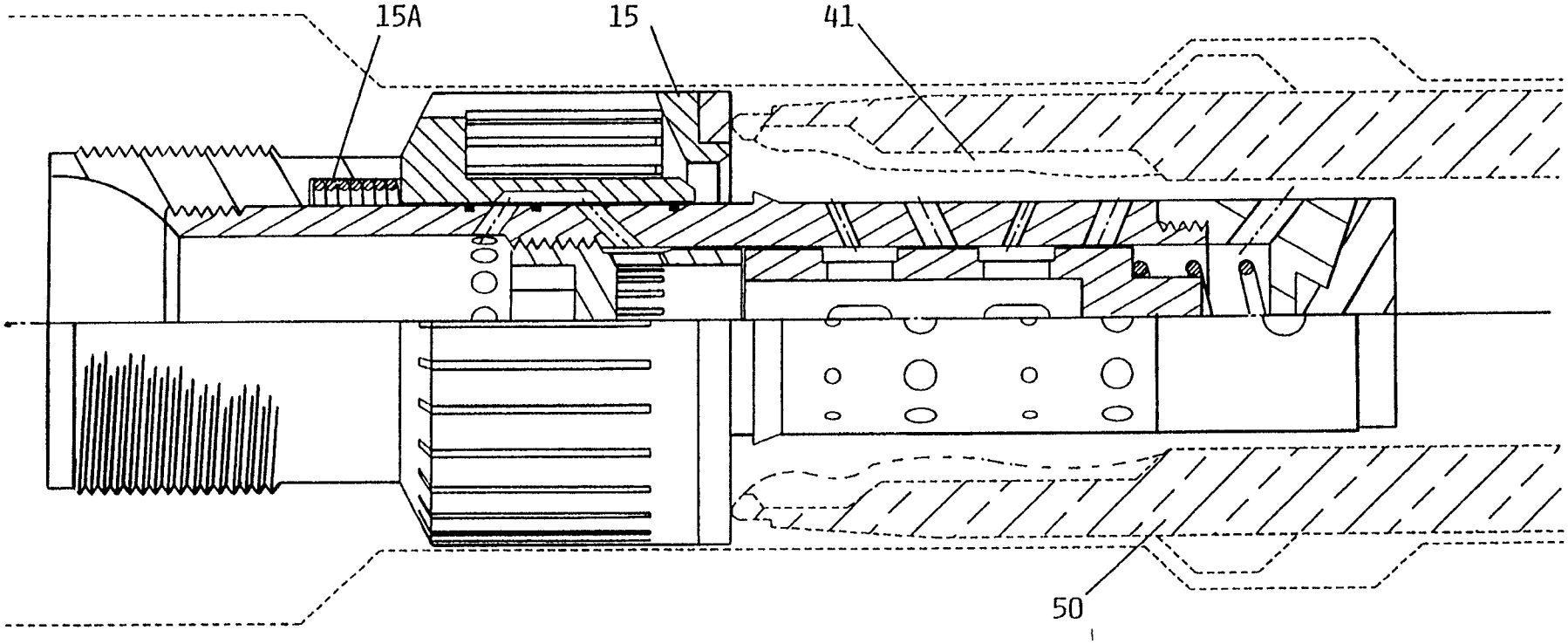
FIG. 5 shows the Tool configured for washing inside a Lock Mandrel, and FIG. 6 in axial section shows the Series Circulation Valve included in the arrangement of FIG. 1.

The cage 15 and its outer parts with nose 29 and lead 17 may both be fabricated with various different outer diameters, depending on the sizes of the well equipment to be washed free from scale. Also available is the ability to wash scale 41 from the inside of the fishing neck of a lock mandrel, as shown in FIG. 5, such that a pulling tool will be able to retrieve it.

Although not essential for correct operation of the Nipple Washing Tool 10, 15, the Series Circulation Valve 3 as shown in FIG. 1 helps in two ways. First, it functions as a swivel and allows the reactive torque generated by unbalanced jets of fluid to dissipate as tool rotation. This is important since the coiled tubing 1 will usually be under compression and therefore buckled during washing operations, and external torque could build up and cause failure when the coiled tubing is pulled out of the well.

The Series Circulation Valve 3 shown in FIG. 6 comprises a main housing composed of housing parts 60A, 60B and 60C enclosing an upper chamber 61 and a lower chamber 62. A piston 63 with a seal 63A is held in housing 60A,B,C by shear pins 65 which constitute breakable first retaining means. The upper housing part 60A is connected to the intermediate part 60B by a threaded collar 68 which retains two semicircular retaining bushings 72. These capture a lower upset 71 of the intermediate housing part 60B between low-friction washers 70A,B-70C,D allowing free rotation between parts 60A and 60B. O-rings 69 form a pressure seal.

Second, as can be seen in FIG. 6, the Series Circulation Valve 3 blocks coiled tubing pressure P while running the washing tool into the well. This avoids premature circulation caused by snagging of the cage 15 on the tubing wall and opening of the bypass valve 14. When at the correct depth, pressure P in the coiled tubing 1 is increased to a predetermined value which causes the pin 65 to shear under the influence of force generated by the piston 63. Subsequent movement of the piston and the locking thereof in its lower position will then result in fluid communication to the Nipple Washing Tool 10, 15 below (FIG. 1) via the open external bypass valve 14. This locking is provided for by a spring element 67, which may be regarded as second retainer means in this valve structure.

I claim:

1. A washing tool for removing internal deposits in pipes, tubes, and tubing parts and components in boreholes and wells for oil or gas production, wherein the washing tool is adapted to be run down at the end of hollow tubing such as coiled tubing and to be operated by fluid pressure of a washing fluid supplied through said hollow tubing, the washing tool comprising: a main body having a generally hollow cylindrical shape and being provided with substantially radial holes for discharging the washing fluid therethrough, and a valve member which is axially movable within the main body under pressure actuation against a first spring for opening one or more of the substantially radial discharge holes in the main body, characterized in that said substantially radial discharge holes are in the form of respective small and large nozzle openings located along a lower portion of said main body, the small and large nozzle openings allowing jets of washing fluid to pass therethrough;

an external valve member at an upper portion of said main body is arranged for axial movement in relation to the main body against the action of a second spring tending to urge said external valve member in a direction downwards to a position whereby the external valve member blocks said washing fluid being supplied from said hollow tubing from entering said lower portion;

an actuation sleeve is associated with said external valve member and is provided with outer parts having maximum lateral dimensions determined in relation to the dimensions of said tubing parts or said components, from which deposits are to be removed, so that said actuation sleeve will move said external valve member axially upwards in relation to said main body with a resulting admission of said washing fluid from above, into said lower portion when said actuation sleeve is pressed against a deposit to be removed, and;

said valve member is adapted to be moved axially by said fluid pressure between an upper position in which a first washing fluid flow is allowed to flow through said small nozzle openings with the simultaneous formation of a pressure difference axially across said valve member which is high enough for overcoming the force of said spring, and a lower position in which a second washing fluid flow which is substantially larger than said first washing fluid flow is allowed to flow through said large nozzle openings with a simultaneous strong reduction of said pressure difference so that said valve member is pressed by said first spring back to the upper position, and wherein said valve member alternately continues in reciprocating movement between the upper and lower positions as long as said washing fluid is supplied through said hollow tubing.

2. A washing tool according to claim 1, characterized in that said actuation sleeve has slots therein such that said washing fluid can flow freely back upwards through said slots after passing through said main body, whereby large pieces of removed deposits will be trapped by said slotted sleeve for further dissolution.

3. A washing tool according to claim 1, further comprising means for mounting a ring of lead or other yielding material on a leading edge of said sleeve such that an impression of obstructing deposits or material may be made and retrieved to the surface with the washing tool.

4. A washing tool according to claim 1, further comprising a nose part connected to a lower end of the main body and having an outer diameter smaller than the lateral dimensions or diameter of said sleeve and larger than the outer diameter of said main body.

5. A washing tool according to claim 4, further comprising means for mounting a filling of lead or other yielding material on a leading edge of said nose part such that an impression of obstructing deposits or material may be made and retrieved to the surface with the washing tool.

6. A washing tool according to claim 4, characterized in that said nose part is interchangeable with another nose part used for a specialized function.

7. A washing tool according to claim 1 further comprising a hollow ball swivel joint connecting the washing tool to said hollow tubing.

8. A washing tool according to claim 6, wherein the specialized function is washing scale from an internal fishing neck and the nose part is a narrow nose part.

9. A washing tool according to claim 1, further including a valve operatively connected to the washing tool to control access of the washing fluid to the washing tool, the valve comprising:

a main housing having first and second housing parts and upper and lower chambers, a piston having a bypass and being disposed in the main housing;

a breakable first retaining device engaged with the piston to retain the piston in a first position;

a first seal operatively connected to the piston to prevent the washing fluid from flowing from the upper chamber to the lower chamber when the piston is retained in the first position by the first breakable retaining means;

a second retaining device engaged with the piston to retain the piston in a second position in the lower chamber;

a swivel joint connecting the first and second housing parts to each other; and means for preventing rotation of the coiled tubing due to rotation of the washing tool, the preventing means including a second seal disposed between the first and second housing parts, low friction bearings surrounding a portion of the second housing part, retaining bushings, a threaded collar mounted on the first housing part to retain the retaining bushings in place whereby the retaining bushings retain the portion of the second housing part between the low friction bearings;

wherein when fluid pressure of the washing fluid reaches a predetermined value the first retaining device no longer retains the piston in the first position and the piston moves to the second position thereby permitting the washing fluid to flow through the bypass to the washing tool.

* * * * *